US007168823B1

(12) United States Patent
Jones

(10) Patent No.: US 7,168,823 B1
(45) Date of Patent: Jan. 30, 2007

(54) INTERNALLY ILLUMINATED OBJECTS

(76) Inventor: Garland R. Jones, 8006 Grenoble St., Amarillo, TX (US) 79110

( * ) Notice: Subject to any disclaimer, the term of this patent is extended or adjusted under 35 U.S.C. 154(b) by 111 days.

(21) Appl. No.: 11/041,378

(22) Filed: Jan. 24, 2005

Related U.S. Application Data

(63) Continuation-in-part of application No. 10/684,906, filed on Oct. 14, 2003, now abandoned.

(60) Provisional application No. 60/542,122, filed on Feb. 5, 2004.

(51) Int. Cl.
*F21S 13/14* (2006.01)

(52) U.S. Cl. ..... 362/252; 362/228; 362/240; 362/800

(58) Field of Classification Search ..... 362/228, 362/240, 252, 545, 646, 800; 340/815.45; 313/500
See application file for complete search history.

(56) References Cited

U.S. PATENT DOCUMENTS 5,561,346 A * 10/1996 Byrne ..... 362/252
6,948,829 B2 * 9/2005 Verdes et al. ..... 362/252

* cited by examiner

*Primary Examiner*—Stephen F Husar
(74) *Attorney, Agent, or Firm*—Ted Masters

(57) ABSTRACT

An internally lighted object includes a housing which is fabricated from either a transparent material or a translucent material. A selectively energizable light source is contained within the housing so that when the light source is energized the object shines. In a preferred embodiment of the invention the light source includes one or more light emitting diodes.

6 Claims, 8 Drawing Sheets

INTERNALLY ILLUMINATED OBJECTS

CROSS REFERENCE TO RELATED APPLICATION

This application is a Continuation-In-Part of application Ser. No. 10/684,906, filed Oct. 14, 2003 now abandoned, which is included herein by reference. Additionally, this application claims the filing benefit under 35 U.S.C. §119(e) of U.S. Provisional Application No. 60/542,122, filed Feb. 5, 2004, which is included herein by reference.

TECHNICAL FIELD

The present invention pertains generally to lighting products, and more particularly to objects which are internally illuminated by an embedded light source.

BACKGROUND OF THE INVENTION

A light source embedded in a transparent or translucent object causes the object to shine, and produces vivid color displays which enhance either an indoor or outdoor setting. Such objects are typically made from polymers or glass, and contain an embedded light source such as a light emitting diode (LED). The form of the objects can range from flowers to underwater figurines, and from beverage holders to trailer lights.

For example, U.S. Pat. No. 5,165,778 illustrates an aquarium lighting system for underwater illumination of an aquarium tank. The light sources each include an elongated insulated wire having a light emitting diode on one end. A water impervious encapsulating layer of material extends over the LED lens and preferably seals and electrically insulates the connection between the elongated wire and the light emitting diode. The wire insulation is both waterproof and watertight. The plug has an opening extending therethrough which cooperates with an attachment mechanism such as a tie wrap or a suction cup to facilitate attaching the light emitting diode to either an object within the tank or the tank walls. A decorative aquarium volcano and display stand also are shown.

BRIEF SUMMARY OF THE INVENTION

The present invention is directed to transparent and/or translucent objects which contain a selectively energizable embedded light source which causes the object to shine thereby enhancing its beauty. The object can be a figurine, a flower, a beverage holder, a landscape light, or any other item which would benefit from an internally located lighting source. If the object is translucent, then the housing of the object diffuses the light from the light source. If the object is transparent, a coating placed on the external surface of the object diffuses the light from the light source. The light can transform an otherwise dull object into a vivid colored display. The light from the object is particularly beautiful in a darkened environment. In a preferred embodiment of the invention, the light source comprises light emitting diodes (LEDs), which are molded into the object, which consume very little power, and have a life of up to 100,000 hours.

Heretofore an object such as a beautiful artificial flower wreath or basket would have to be highlighted by a spot light type light source directed onto the flower arrangement to illuminate the vivid colors of the flowers. With the present invention these vivid colors can be captured by LEDs molded into the flower itself so no external lighting is required.

In an embodiment of the invention a circuit board having a plurality of LED attachment stations permits the connection of as many LEDs as are required to achieve a desired lighting effect. In a disclosed embodiment of the invention the number of LEDs can range from one through twelve. The LEDs are soldered onto the circuit board along with appropriate resistors. The circuit board with attached LEDs and resistors is then encapsulated into a solid mold of liquid acrylic or plastic resin. When the resin has cured the object can be painted or a resin colorant can be used. The object is then plugged into an electrical outlet or connected to a battery.

In accordance with a preferred embodiment of the invention, an internally illuminated object comprises a housing which is at least one of transparent and translucent. A selectively energizable light source is disposed within the housing. The light source includes a circuit board having a first side and an opposite second side, the first side includes a plurality of light emitting diode attachment stations. The light emitting diode attachment stations include an outer set of attachment stations and an inner set of attachment stations, wherein the outer set of attachment stations is disposed in rotationally staggered relationship with respect to the inner set of attachment stations. At least one light emitting diode is connected to at least one of the light emitting diode attachment stations.

In accordance with an aspect of the invention, the outer set of attachment stations includes six attachment stations, and the inner set of attachment stations including six attachment stations.

In accordance with another aspect of the invention, at least one socket is disposed on the second side of the circuit board, the socket for receiving a halogen light.

In accordance with another aspect of the invention, the outer set of attachment stations is disposed in circular spaced apart relationship, and the inner set of attachment stations is disposed in circular spaced apart relationship.

In accordance with another aspect of the invention, the circuit board has a central axis, and the at least one light emitting diode has a direction of radiation. The at least one light emitting diode is connected to the circuit board so that the direction of radiation of is angled away from the central axis of the circuit board.

In accordance with another aspect of the invention, the light source includes an annular circuit board having a plurality of light emitting diode attachment stations, wherein at least one light emitting diode is connected to at least one light emitting diode attachment station.

In accordance with another aspect of the invention, an internally illuminated object includes a transparent housing having an external surface. The external surface has a translucent coating.

In accordance with another aspect of the invention, the translucent coating is of uneven thickness so that the external surface of the housing shines unevenly when the light source is energized.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
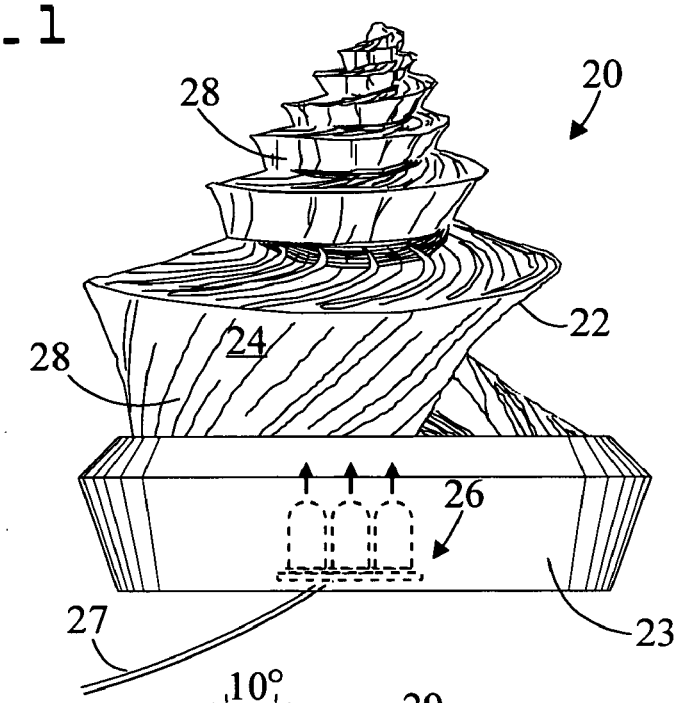
FIG. 1 is a side elevation view of an internally illuminated object in accordance with the present invention.

Referring initially to FIG. 1, there is illustrated a side elevation view of an internally illuminated object in accordance with the present invention, generally designated as 20. In the shown embodiment, object 20 is shaped like a sea shell, however other shapes such as a flower (refer to FIG. 8), or a beverage holder (refer to FIG. 14) are also possible. Object 20 includes a housing 22 having a external surface 24. Housing 22 is at least one of transparent and translucent. For example, housing 22 can be fabricated from a clear polymer or glass, or could be fabricated from a translucent polymer or glass. In an embodiment of the invention, housing 22 is solid rather than hollow. A selectively energizable light source 26 is disposed within housing 22, so when light source 26 is energized object 20 will shine. In an embodiment of the invention light source 26 is embedded in solid housing 22, such as by casting in a polymer resin. In another embodiment of the invention, light source 26 is placed near the bottom of object 20 and directed upward so that the entire object 20 will shine. In a preferred embodiment of the invention, light source 26 comprises at least one light emitting diode (LED) 25. The light emitted by light emitting diode 25 can be one of a plurality of colors. For example a red light emitting diode 25 will emit a red color, a blue light emitting diode 25 a blue color, etc. Other available color light emitting diodes 25 include green, purple, orange, yellow, etc. Light emitting diodes 25 are also available which emit multiple colors on a time sequenced basis. Housing 22 also has a base 23 which can be placed upon any convenient support surface. In the shown embodiment, light source 26 is disposed in base 23.

In an embodiment of the invention, if housing 22 is transparent, then external surface 24 has a translucent coating 28 such as paint. Translucent coating 28 diffuses the light from light source 26 so that the external surface 24 of object 20 shines. In another embodiment of the invention, translucent coating 28 is purposely made an uneven thickness so that external surface 24 of object 20 shines unevenly when light source 26 is energized. That is, bright and less bright spots will appear on external surface 24 of object 20. Leads 27 connect light source 26 to a power source such as 6 volts DC. Power may either be supplied from an electrical outlet or from a battery.

Figure 2:
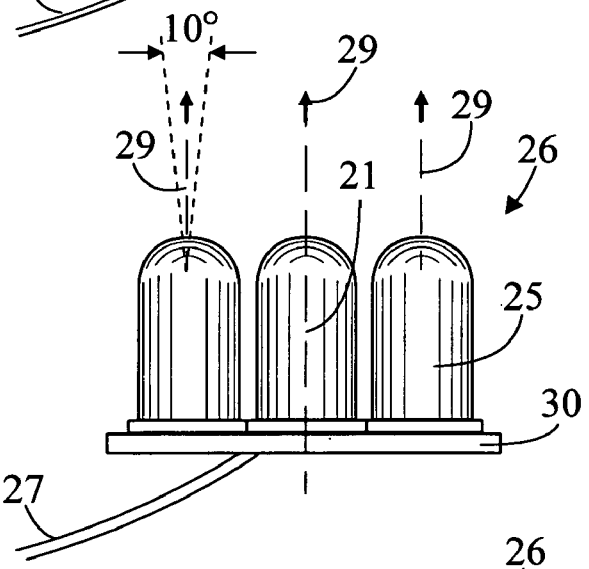
FIG. 2 is an enlarged side elevation view of a selectively energizable light source including a circuit board.
Figure 3:
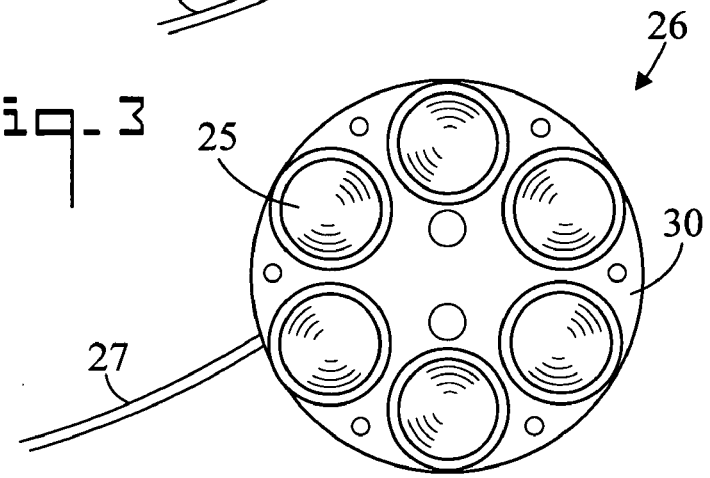
FIG. 3 is an enlarged top plan view of the light source.

FIGS. 2 and 3 are enlarged side elevation and top plan views respectively of a selectively energizable light source 26. Light source 26 includes a circuit board 30 (typically a printed circuit board) having a central axis 21. A plurality of light emitting diodes 25 are connected to circuit board 30. In the shown embodiment, light source 26 comprises six light emitting diodes 25 disposed in a circular arrangement with each light emitting diode having a direction of radiation 29. The six light emitting diodes increase the intensity of light source 26 and thereby cause object 20 to shine more brightly. The multiple light emitting diodes will also light a larger object 20. Also, different color light emitting diodes 25 may utilized to obtain a blending of colors on the external surface 24 of object 20.

The six light emitting diodes 25 are mounted in a circular arrangement on a circular circuit board 30 having a central axis 21. The direction of radiation 29 of each light emitting diode 25 is substantially parallel to the direction of radiation of every other light emitting diode 25 and also substantially parallel to central axis 21. In the shown embodiment, each light emitting diode 25 has a radiation pattern of about 10°.

Figure 4:
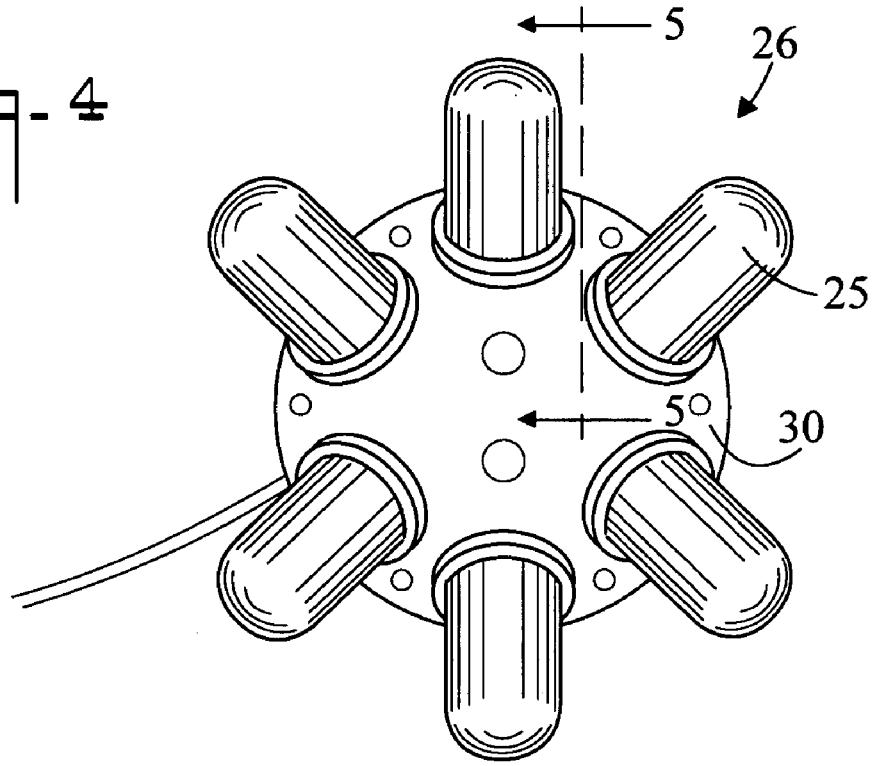
FIG. 4 is an enlarged top plan view of a second embodiment of the light source.
Figure 5:
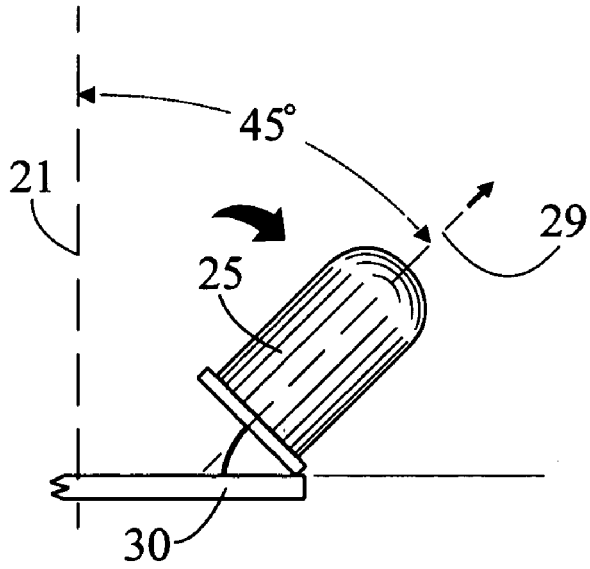
FIG. 5 is a view along the line 5—5 of FIG. 4.

FIG. 4 is an enlarged top plan view of a second embodiment of light source 26, and, and FIG. 5 is a view along the line 5—5 of FIG. 4. In this embodiment the six light emitting diodes 25 are connected in a circular arrangement to circuit board 30 which has a central axis 21. Each of the six light emitting diodes 25 is oriented so that its direction of radiation 29 is angled away from central axis 21 of circuit board 30. That is, light emitting diodes 25 are bent outward at an angle from central axis 21. A bend of about 45° has been found useful. In this fashion the light from light emitting diodes 25 is spread over a greater portion of external surface 24 of object 20.

Figure 6:
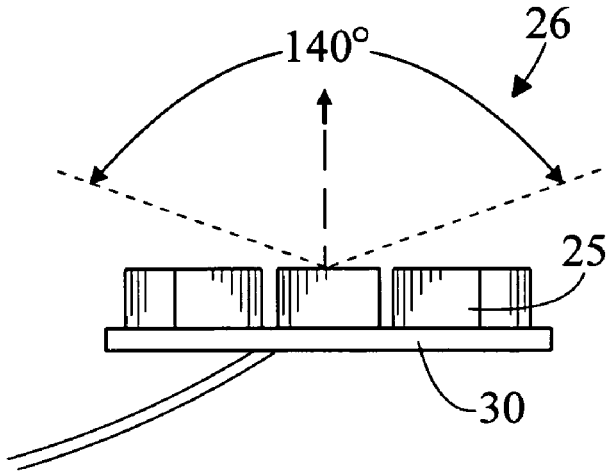
FIG. 6 is an enlarged side elevation view of a third embodiment of the light source.
Figure 7:
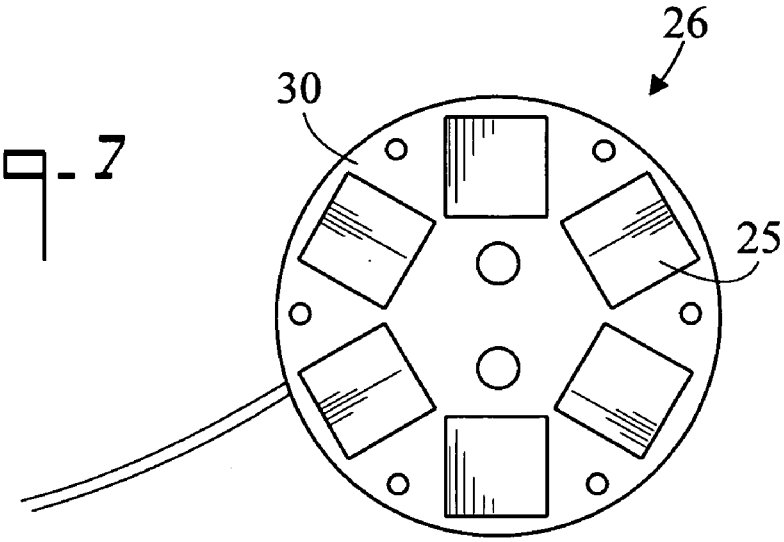
FIG. 7 is an enlarged top plan view of FIG. 6.

FIGS. 6 and 7 are enlarged side elevation and top plan views respectively of a third embodiment of light souce 26. In this embodiment the light emitting diodes 25 each consist of a rectangular body which radiates light in a 140° pattern, and therefore more evenly spreads light on external surface 24 (refer to FIG. 1).

Figure 8:
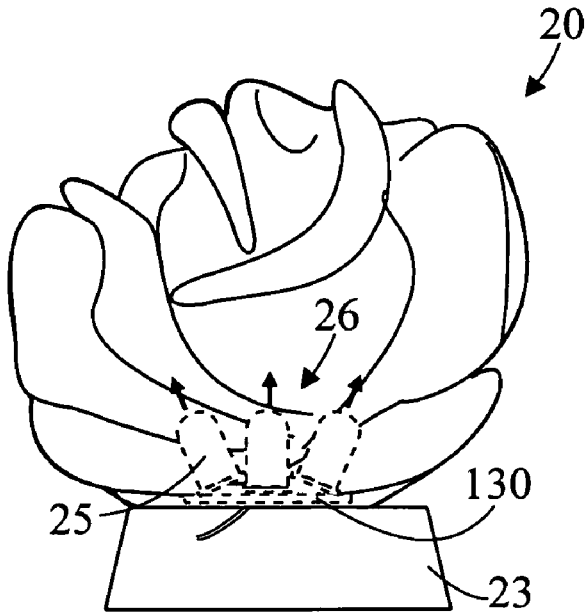
FIG. 8 is a side elevation view of a second internally illuminated object.

FIG. 8 is a side elevation view of a second internally illuminated object 20. In this instance object 20 is a rose which sits upon base 23.

Figure 9:
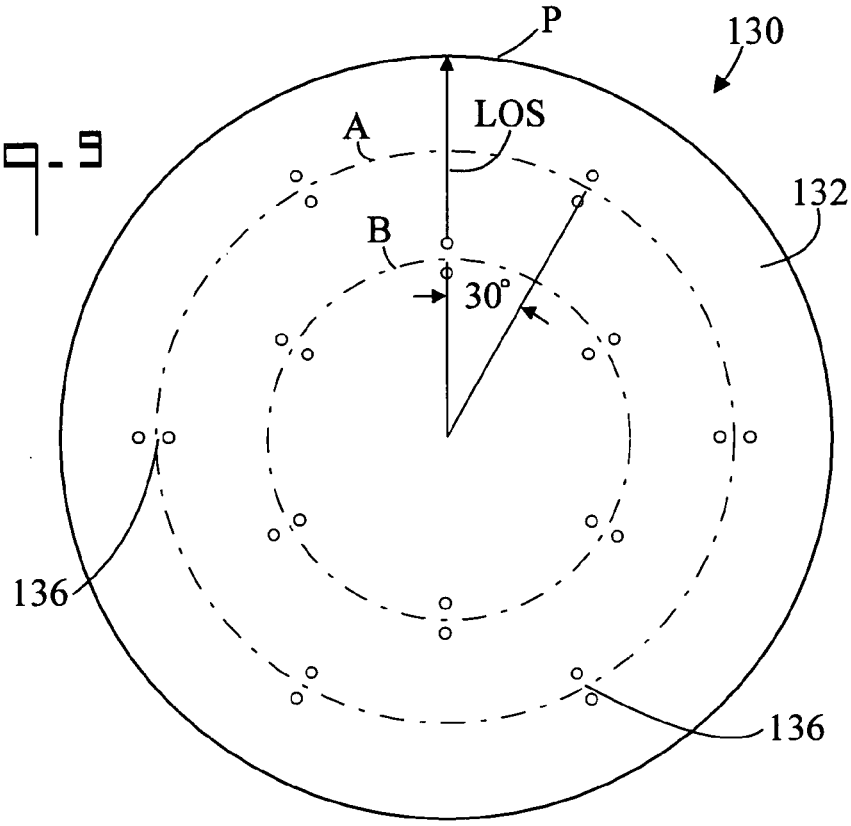
FIG. 9 is an enlarged top plan view of a second circuit board.

FIG. 9 is an enlarged top plan view of a second circuit board 130 used in light source 26. Circuit board 130 has a first side 132 and an opposite second side 134 (refer to FIG. 12). First side 132 includes a plurality of light emitting diode attachment stations 136 (twelve in the shown embodiment). Light emitting diode attachment stations 136 comprise sockets which accept the terminals of light emitting diodes 25. Light emitting diode attachment stations 136 including an outer set of attachment stations 136 (disposed in spaced apart relationship around imaginary circle A), and an inner set of attachment stations 136 (disposed in spaced apart relationship around imaginary circle B). In the shown embodiment both the outer set (A) of attachment stations 136 and the inner set (B) of attachment stations 136 include six attachment stations 136. It may be appreciated however, that a circuit board 130 with a lesser or greater number of light emitting diode attachment stations 136 could also be utilized.

The outer set of attachment stations 136 is disposed in rotationally staggered relationship with respect to said inner set of attachment stations 136. That is, the inner set of attachment stations 136 are rotationally offset from the outer set of attachment stations 136 by an angular amount (30° in the shown embodiment) so that each inner attachment station 136 has an unobstructed line of sight LOS to the perimeter P of circuit board 130. In other words, the outer set of attachment stations 136 does not block the inner set of attachment stations 136 such as could otherwise happen with the angled LEDs of FIG. 10. If all attachment stations 136 are filled with LEDs, this geometric arrangement tends to even out the light emanating from light source 26.

Figure 10:
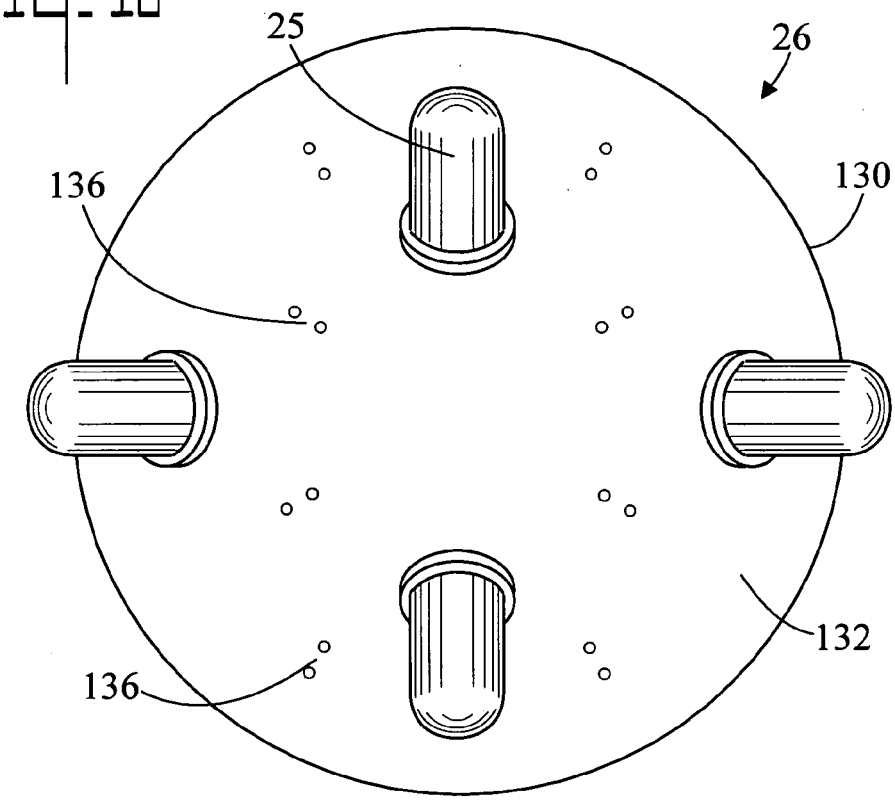
FIG. 10 is an enlarged top plan view of light emitting diodes installed on the second circuit board of FIG. 9.

FIG. 10 is an enlarged top plan view of light emitting diodes 25 installed on second circuit board 130 of FIG. 9. A light emitting diode 25 is connected to at least one of the light emitting diode attachment stations 136 as is required to achieve the desired lighting effect. For example, one light emitting diode 25 could be connected to one attachment station 136, three light emitting diodes 25 could be connected to three attachment stations 136 four light emitting diodes 25 could be connected to four attachment stations 136, etc. (wherein a single light emitting diode 25 is connected to a single attachment station 136).

Figure 11:
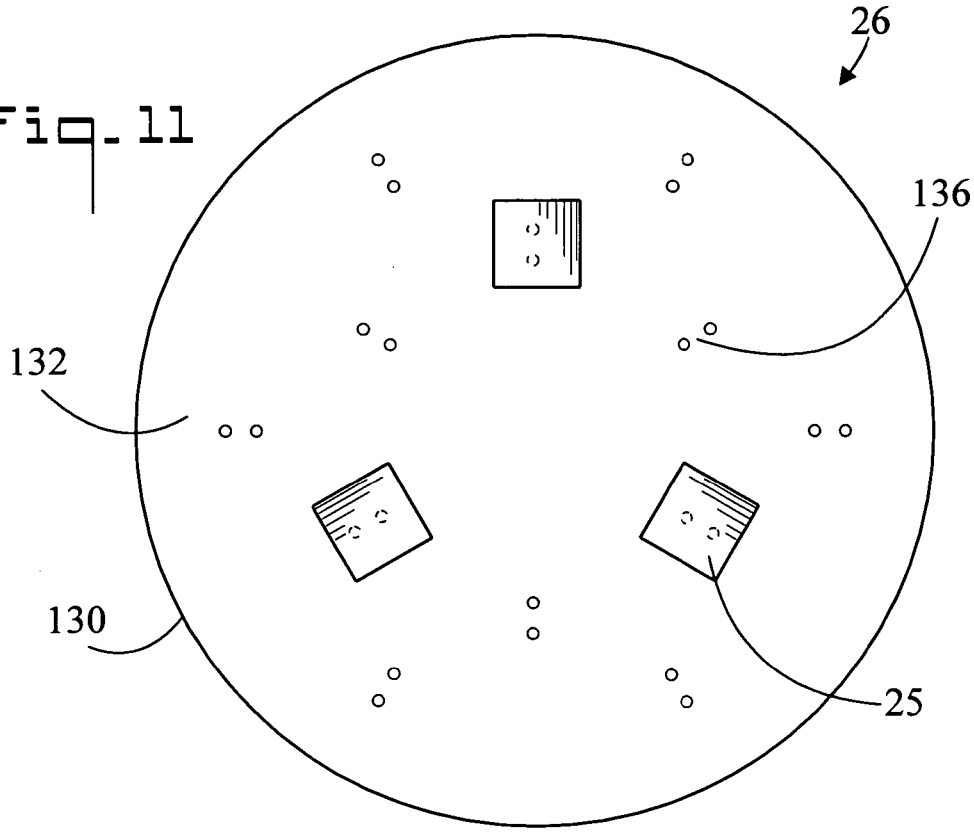
FIG. 11 is an enlarged top plan view of light emitting diodes installed on the second circuit board of FIG. 9.

FIG. 11 is an enlarged top plan view of light emitting diodes 25 installed on the second circuit board 130 of FIG. 9. In this embodiment three light emitting diodes 25 have been installed to achieve a desired lighting effect.

Figure 12:
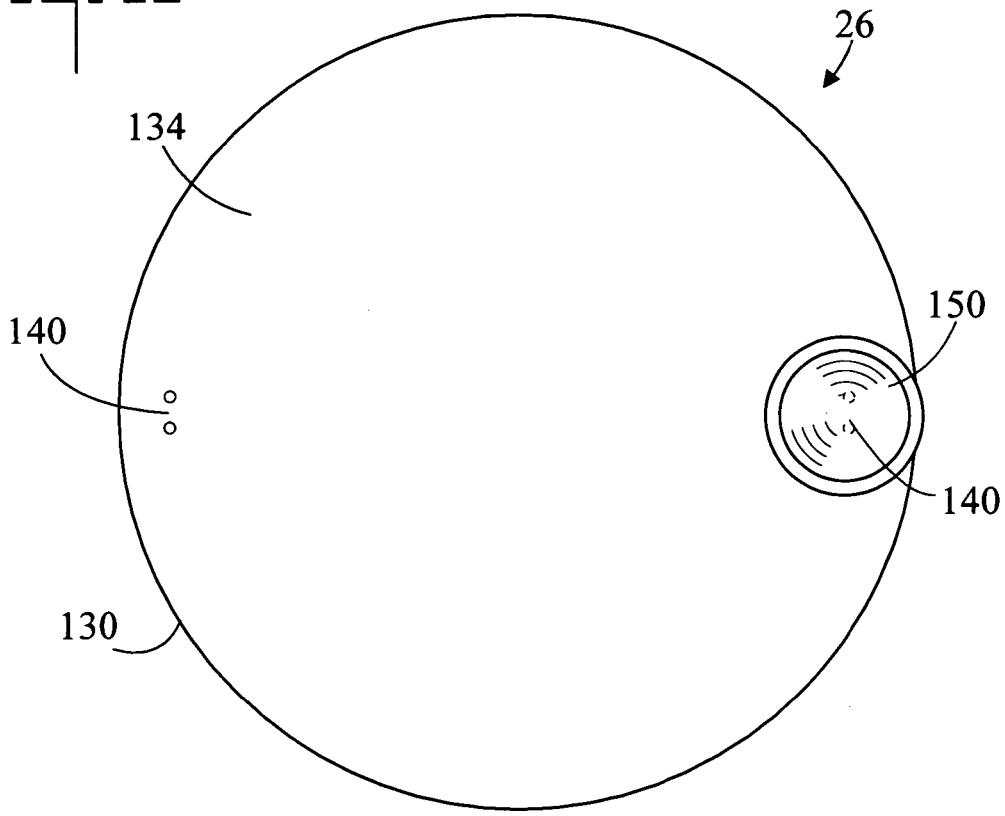
FIG. 12 is an enlarged bottom plan view of the second circuit board of FIG. 9.

FIG. 12 is an enlarged bottom plan view of the second circuit board of FIG. 9 showing second side 134. At least one socket 140 is disposed on second side 134 of circuit board 130. Socket 140 is designed to receive a halogen light 150. In this fashion, light source 26 projects light from both its top 132 (via LEDs 25) and from its bottom 134 (via halogen light 150) sides (refer to FIG. 13).

Figure 13:
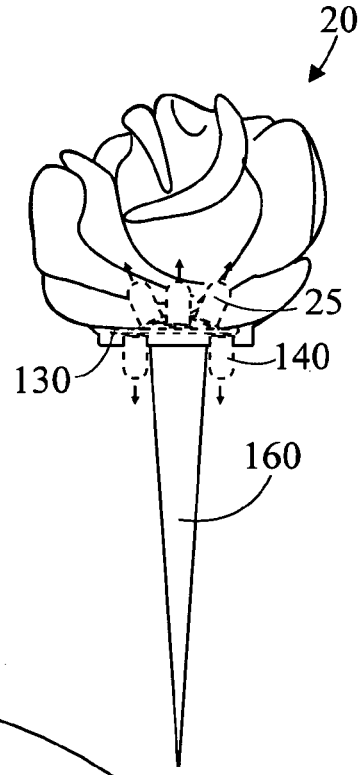
FIG. 13 is a reduced side elevation view of a third internally illuminated object which projects light both upwardly and downwardly.

FIG. 13 is a reduced side elevation view of a third internally illuminated object 20 which projects light both upwardly and downwardly. Light emitting diodes 25 project light upwardly into object 20, and halogen light 150 projects light downwardly. This embodiment would be useful as landscape lighting for illuminating the sides of an outdoor walkway wherein an attached stake 160 is used to plant object 20 in the ground along the walkway. In another application, this dual-sided light projection embodiment could be applied to water lilies, wherein both the floating top flower and the bottom of the pool or pond are illuminated.

Figure 14:
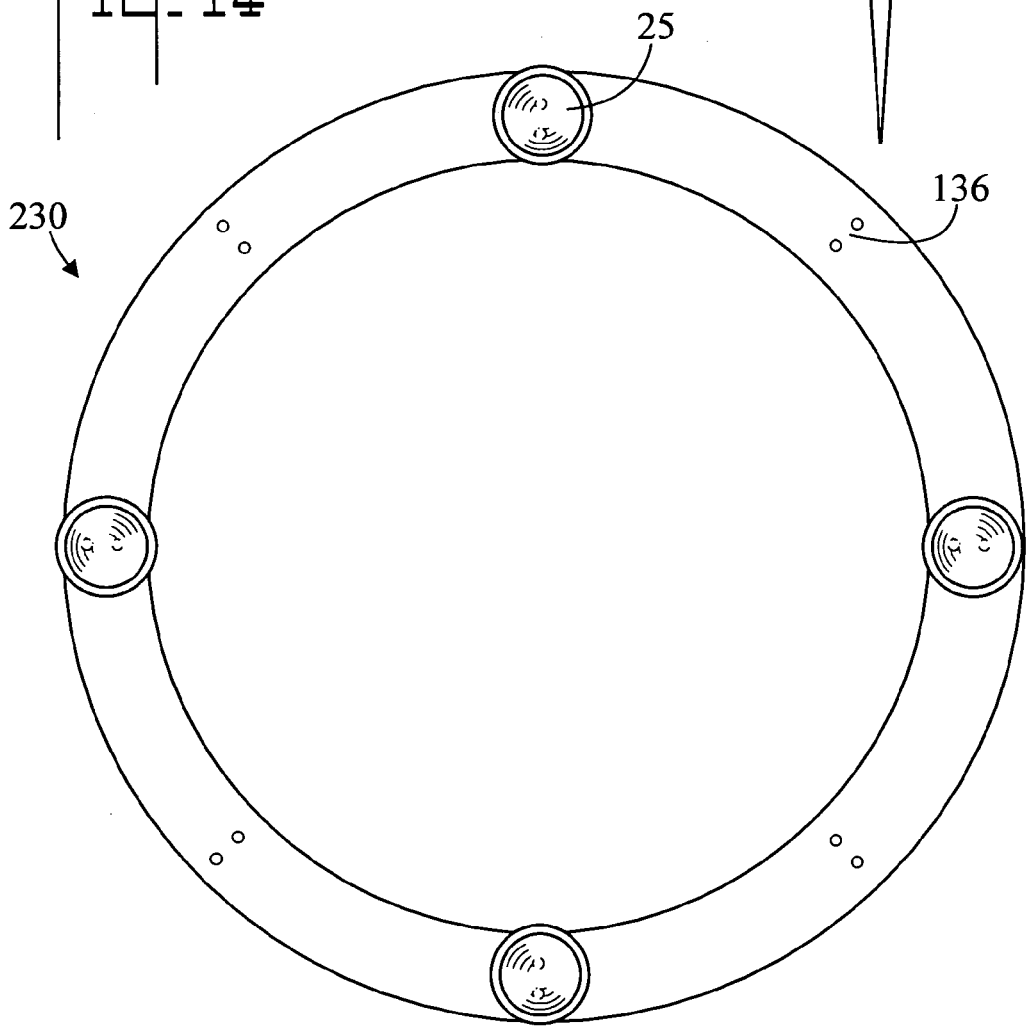
FIG. 14 is an enlarged top plan view of a third circuit board.
Figure 15:
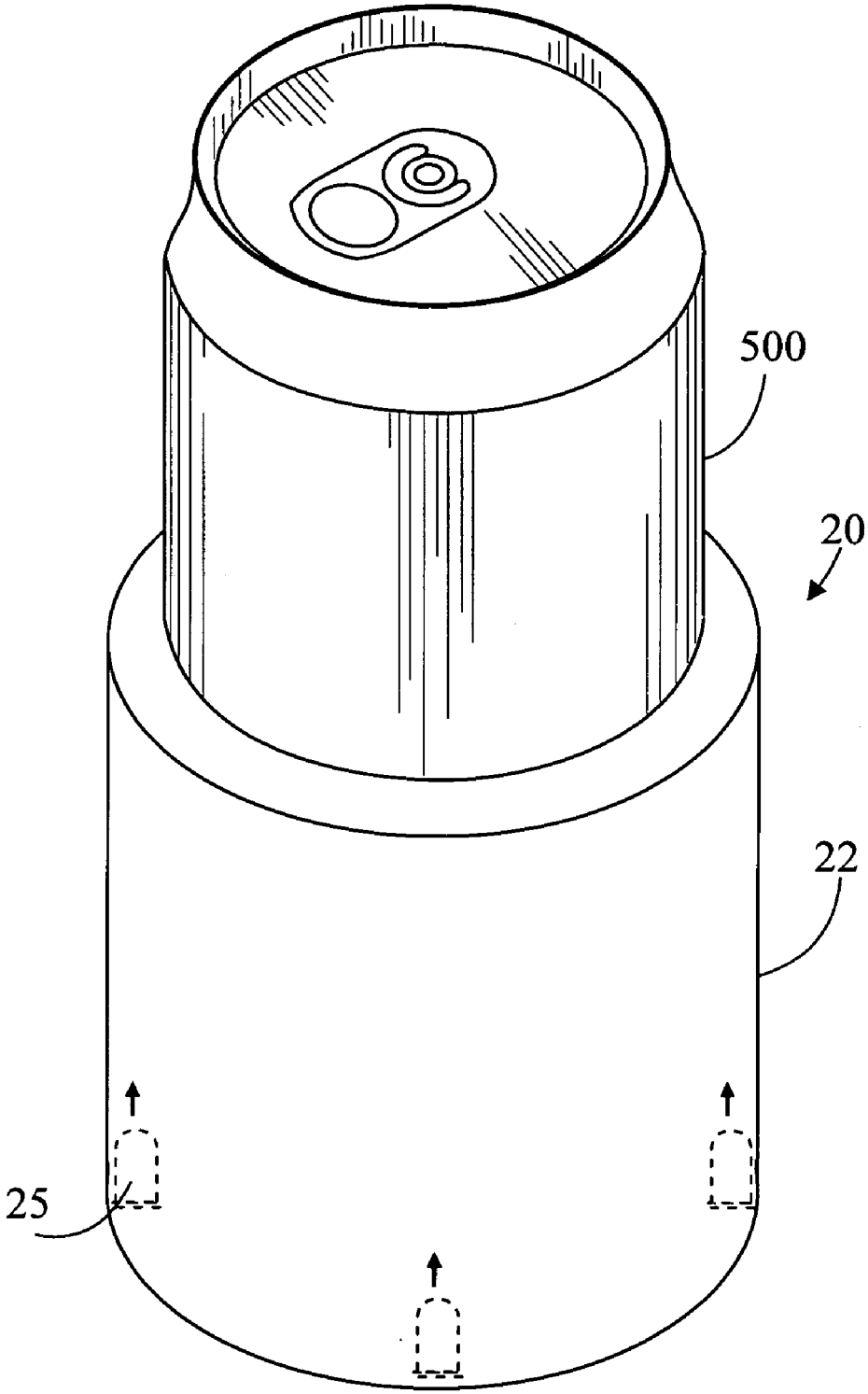
FIG. 15 is a perspective view of a fourth illuminated object.

FIG. 14 is an enlarged top plan view of a third circuit board 230 used in light source 26, and FIG. 15 is a perspective view of a fourth illuminated object 20. In this embodiment internally illuminated object 20 is a holder for receiving a beverage container such as a can or bottle 500. Object 20 includes a housing 22 shaped and dimensioned to receive beverage container 500, housing 22 being at least one of transparent and translucent. Light source 26 includes an annular circuit board 230 having a plurality of light emitting diode attachment stations 136. In the shown embodiment four light emitting diodes 25 are attached to four of the eight attachment stations 136. The light emitting diodes 25 illuminate the holder. In this embodiment a battery could be provided so that the holder may be conveniently moved about.

Figure 16:
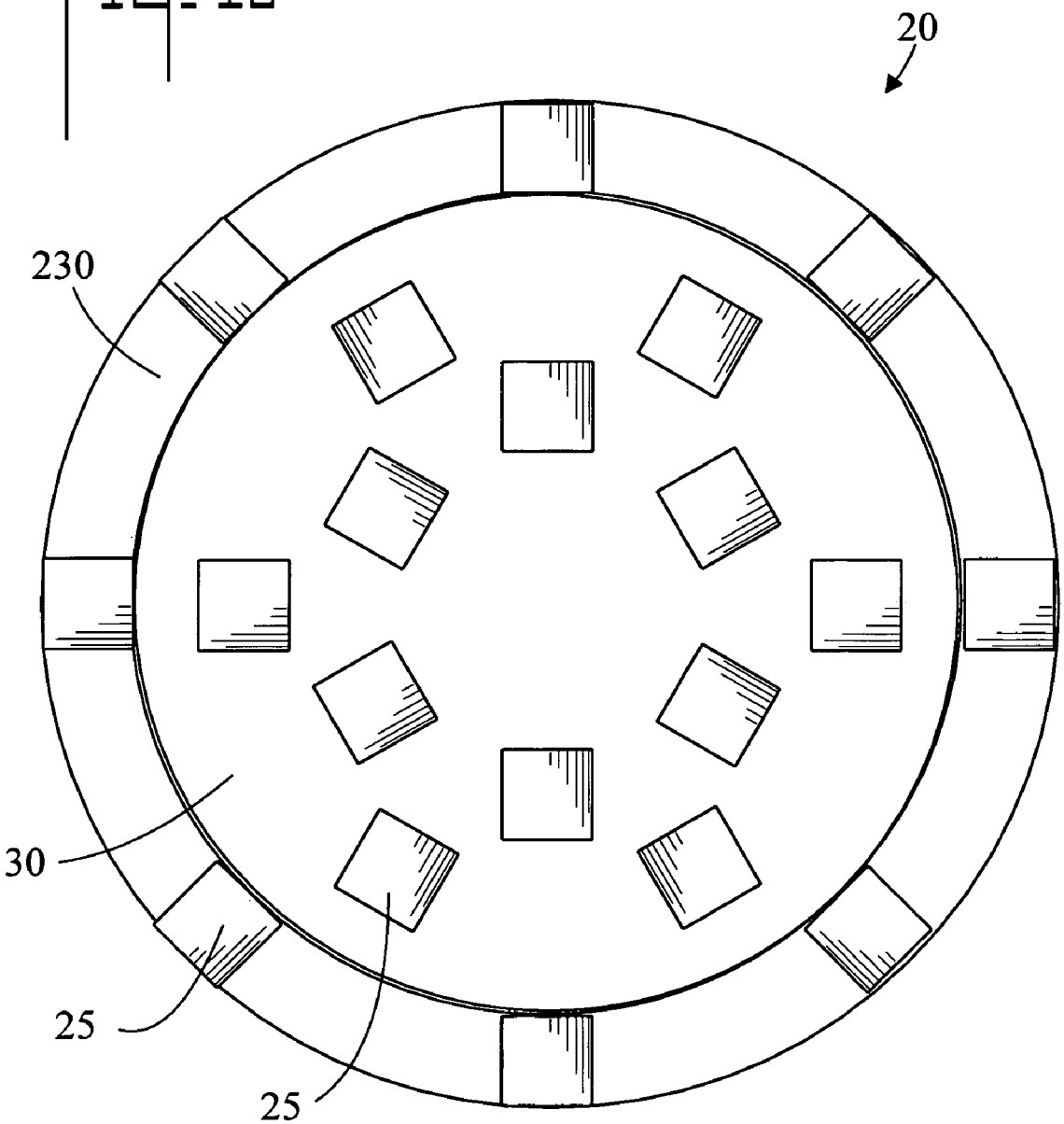
FIG. 16 is an enlarged top plan view of a fifth illuminated object.

FIG. 16 is an enlarged top plan view of a fifth illuminated object 20, a trailer light. Light source 26 includes both circuit board 130 (refer to FIG. 9) and circuit board 230 (refer to FIG. 14), wherein circuit board 230 is fitted into circuit board 130.

The preferred embodiments of the invention described herein are exemplary and numerous modifications, variations, and rearrangements can be readily envisioned to achieve an equivalent result, all of which are intended to be embraced within the scope of the appended claims.

I claim:

1. An internally illuminated object, comprising:

a housing, said housing being at least one of transparent and translucent;

a selectively energizable light source disposed within said housing;

said light source including a circuit board having a first side and an opposite second side, said first side including a plurality of light emitting diode attachment stations; and, said light emitting diode attachment stations including an outer set of attachment stations and an inner set of attachment stations, wherein said outer set of attachment stations is disposed in rotationally staggered relationship with respect to said inner set of attachment stations.

2. The internally illuminated object according to claim 1, further including:

said outer set of attachment stations including six said attachment stations; and, said inner set of attachment stations including six said attachment stations.

3. The internally illuminated object according to claim 1, further including:

at least one socket disposed on said second side of said circuit board; and, said socket for receiving a halogen light.

4. The internally illuminated object according to claim 1, further including:

said outer set of attachment stations disposed in circular spaced apart relationship; and, said inner set of attachment stations disposed in circular spaced apart relationship.

5. The internally illuminated object according to claim 1, further including:

said outer set of attachment stations including six said attachment stations;

said inner set of attachment stations including six said attachment stations;

at least one socket disposed on said second side of said circuit board;

said socket for receiving a halogen light;

said outer set of attachment stations disposed in circular spaced apart relationship; and, said inner set of attachment stations disposed in circular spaced apart relationship.

6. The internally illuminated object according to claim 1, further including:

said circuit board having a central axis;

at least one light emitting diode having a direction of radiation; and, wherein said at least one light emitting diode is connected to said circuit board so that said direction of radiation is angled away from said central axis of said circuit board.

* * * * *